US005709580A

United States Patent [19]

Stanzel

[11] Patent Number: 5,709,580

[45] Date of Patent: Jan. 20, 1998

[54] CONTROL AND POWER MECHANISM FOR MODEL AIRCRAFT

[76] Inventor: Victor Stanzel, 1102 Lyons Ave., Schulenberg, Tex. 78956

[21] Appl. No.: 654,300

[22] Filed: May 28, 1996

[51] Int. Cl.[6] ..... A63H 27/04

[52] U.S. Cl. ..... 446/31; 446/32

[58] Field of Search ..... 446/31, 32, 33; 244/232, 234

[56] References Cited

U.S. PATENT DOCUMENTS

| | | | |
|---|---|---|---|
| 2,558,109 | 6/1951 | Stanzel | 446/32 |
| 3,018,585 | 1/1962 | Stanzel | 446/33 |
| 3,110,127 | 11/1963 | Benesch | 446/32 |
| 3,579,905 | 5/1971 | Radford | 446/32 |
| 4,011,684 | 3/1977 | Stanzel | 446/32 |
| 5,057,661 | 10/1991 | Banner | 219/56.22 |
| 5,104,344 | 4/1992 | Jancso, Jr. | 446/32 |

*Primary Examiner*—Robert A. Hafer
*Assistant Examiner*—Laura Fossum
*Attorney, Agent, or Firm*—Vinson & Elkins, L.L.P.

[57] ABSTRACT

An electrically powered model aircraft is disclosed in which an on-board electric motor is powered from a ground based electric storage battery. Flight attitude of the aircraft is controlled by torsion control system in which a torsion member is attached at one end to the aircraft and a tubular shaft is disposed about the torsion member, with one end of the tubular shaft being nonrotatably attached to the torsion member at a point spaced from the aircraft and the other end of the tubular shaft being nonrotatably attached to a control device on the aircraft adapted to be operated by rotation of the tubular shaft, to control operation of a control surface of the aircraft. A combination electrical connector and torsion control line extends between, and is releasably mechanically and electrically connected to, the aircraft and to a control handle carried by the airplane operator. Operation of the control handle by the aircraft operator exerts torsional forces on the control line which are transmitted to the torsion member on the aircraft, thereby causing rotation of the tubular shaft and control device, to control operation of the aircraft control surface.

This abstract is not to be construed in any way to define or limit the invention set forth below.

18 Claims, 5 Drawing Sheets

CONTROL AND POWER MECHANISM FOR MODEL AIRCRAFT

FIELD OF THE INVENTION

This invention relates to means for controlling and powering model, or miniature, aircraft, particularly of the type which are self-propelled and self-sustaining in flight by the use of engines, such as on-board electrical engines.

BACKGROUND OF THE INVENTION

Such aircraft normally are controlled in flight by means of one or more control lines extending from a handle held by the flier of the aircraft to some point of attachment on the aircraft itself. Such a control confines the aircraft to an approximately circular flight pattern by reason of the constraining action of the control lines. The aircraft rudder is usually set outwardly prior to take off to maintain a slight outward thrust in the circular flight pattern of the aircraft and no control of the rudder during flight is necessary. In-flight control of the aircraft elevator is commonly provided, however, so that the vertical attitude of the aircraft may be properly controlled during take off, landing and during flight, and the aircraft made to perform stunts, maneuvers, etc.

In the prior art, the most common type of in-flight control for the aircraft elevator is provided by using a double control line extending from the handle to the aircraft and connected in the aircraft to a bell-crank type of control mechanism for operating an aircraft control surface, such as the aircraft elevator, depending on the degree of relative tension applied in the two control lines by manipulation of the handle. While this type of control mechanism has been successfully used for many years, it is somewhat undesirable since, by reason of requiring two control lines, it becomes easily entangled and also increases the weight and air drag on the aircraft. Additionally, it results in almost total loss of control if the control lines become slack during flight.

In prior U.S. Pat. No. 4,011,684, there is shown a torsional control system for model aircraft in which a torsional control line extends from the aircraft to a control handle for rotating the control line, and carries all tensional forces between the aircraft and handle. A solid, flexible shaft has one of its ends attached to the control line at a point spaced from the control line's attachment to the aircraft and the other end attached to a control device on the aircraft adapted to be operated by rotation of the flexible shaft means. Rotation of the control line by the control handle produces a proportional rotation of the flexible shaft and control device without subjecting the control device to line tension in the control line. Such device has proved effective for controlling the elevator on both gasoline powered and electrically powered model aircraft. However, the cam and cam follower arrangement used in such patent for operating the elevator involves substantial friction losses which must be overcome to operate the elevator.

Electric motors for powering toy model aircraft possess advantages in terms of cost, reliability and safety. However, there are problems in providing electrical power for the engines. On board batteries have proved to be too heavy for practical use. For some small toy aircraft, the batteries and motor have been provided in an external unit and rotational power transmitted through a flexible shaft from the motor/battery unit to the aircraft. See, for example, U.S. Pat. No. 4, 133, 139 in which a line-controlled, centrifugal fan, jet-propelled model airplane has the impeller of a fan contained within the fuselage of the aircraft and driven from a battery-powered remote drive unit by elongated flexible cable contained within a flexible sheath. See also, U.S. Pat. Nos. 3,018,585; 3,919,805; 4,573,937 which disclose remotely powered and controlled model aircraft.

With such prior art remotely powered and controlled model aircraft, in which rotational power for the propeller or impeller is provided by a flexible shaft rotating in a flexible sheath, it has not been possible for the operator to also control the aircraft's elevator. Instead, the elevator has been preset to maintain the aircraft in a nose-up attitude or, as in the case of U.S. Pat. No. 4,573,937 and 4,113,139, the rotation of the impeller about an axis perpendicular to the longitudinal axis of the airplane has tended to rotate the aircraft about its lateral axis in a nose-up direction. Additionally, with such prior art remotely-powered toy aircraft, it has not been possible to use powerful motors or very long control lines, due to the battery power requirements for more powerful engines and the substantial frictional losses encountered in rotating the flexible drive shaft within its flexible sheath.

SUMMARY OF THE INVENTION

It is accordingly the primary object of this invention to provide a remotely powered and remotely controlled model aircraft with an on-board electrically-powered engine more powerful than those previously available in electrically-powered model aircraft.

Another object is to provide such a remotely powered and remotely controlled model aircraft with an electrical engine comparable in power to those of typical gasoline engines for model aircraft.

Another object is to provide such a remotely controlled model aircraft in which the control line used for controlling the flight of the aircraft provides means both for operating the elevator or other control surface on the aircraft and for transmitting electrical power from a battery, carried by the aircraft operator, to the on-board electrical motor for powering the aircraft.

A further object is to provide an improved composite control line for model aircraft which comprises both torsion control means for operating an aircraft control surface and electrical connector means for transmitting electrical power between an electrical storage battery carried by the aircraft operator and an on-board electric engine.

These and other objects and advantages of the invention will become apparent from the following specification of the preferred embodiment and from the accompanying drawings.

BRIEF DESCRIPTION OF THE DRAWINGS

In the accompanying drawings, in which like numerals indicate like parts.

DESCRIPTION OF PREFERRED EMBODIMENT

Figure 1:
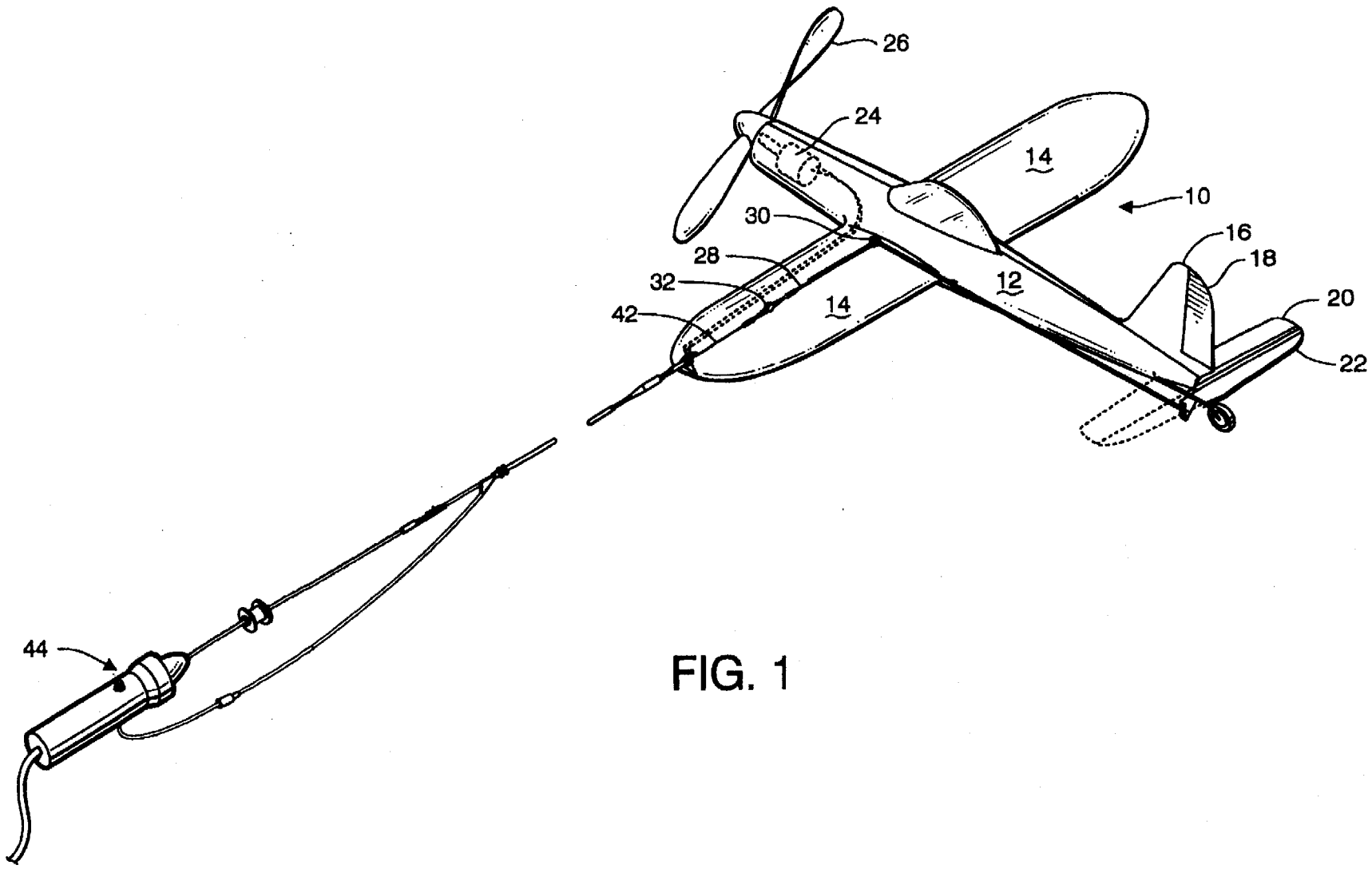
FIG. 1 is a view in perspective of the model aircraft and control mechanism of the present invention, with the aircraft motor, electric leads and a portion of the tail assembly shown in phantom lines.

Referring now to FIG. 1, there is shown a model aircraft 10 including a fuselage 12 with wings 14 fastened thereto, a vertical tail fin 16 with rudder 18 and stabilizers 20 terminating in an elevator 22. Elevator 22 comprises a movable control surface adapted, upon movement, to control the attitude of the aircraft with respect to the ground. The aircraft is self-propelled by means of a motor 24, preferably a DC electric motor, which drives a conventional propeller 26.

Means for controlling operation of the elevator comprise a laterally extending torsion member 28, which is securely nonrotatably attached to the body of the airplane as at anchor point 30. The torsion member 28 is formed of a suitable material, such as straightened music wire, which has the ability to transmit torsional forces by proportional torsional twisting of the wire along its length. Although shown attached to the upper wing, the anchor point 30 may be located elsewhere on the plane, as for example, below the wing or outside or inside the fuselage.

Figure 4:
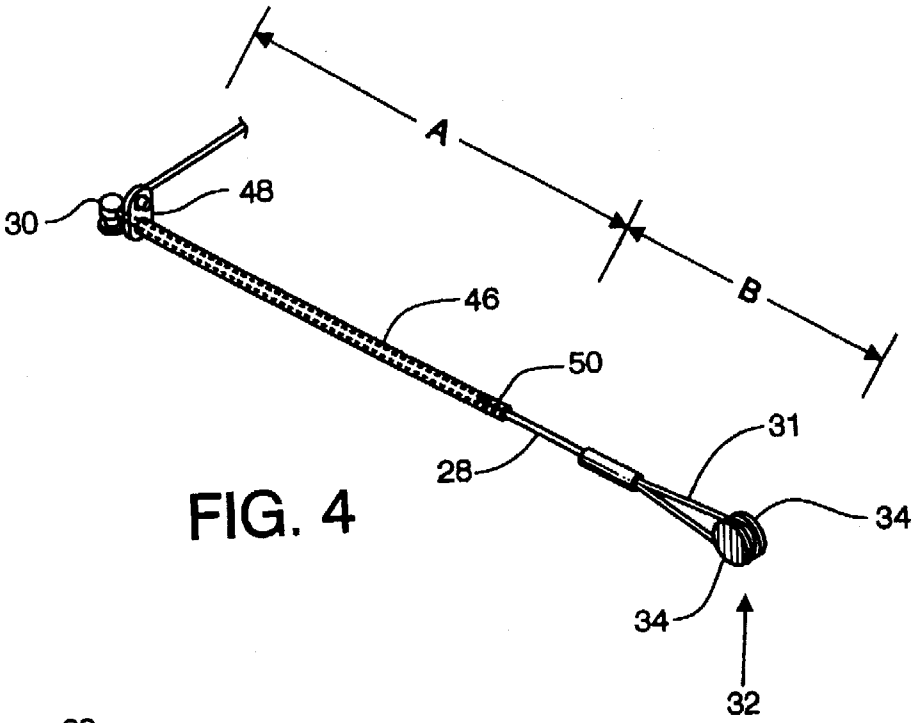
FIG. 4 is an enlarged detail view of a portion of the torsional control apparatus for the aircraft elevator.

The torsion member 28 extends outwardly toward the wing tip and terminates in a loop 31 releasably engaged with torsion transmitting connector means. In the preferred embodiment, shown in FIG. 4, such connector means comprises a button-type connector 32, having two outer flanges 34 connected by a central barrel (not shown). The outer end of torsion member 28 is formed into a loop 32 which is releasably received over one of the flanges in surrounding relationship to the barrel of the button connector 32. A second loop 40 (FIG. 5) is formed at the end of torsion control line 42, which extends to the control handle 44, discussed below. Loop 40 on the control line 42 is adapted to releasably engage connector 32 to thereby provide a releasable connection between control line 42 and torsion member 28 for transmitting both tension and torsional forces between the control line and the torsion member.

A small diameter, thin wall hollow metal tube or shaft 46, having an inside diameter slightly larger than the outside diameter of the torsion member 28 is positioned in surrounding relationship to the torsion member 28 and floats or bears on the torsion member 28. Tubular shaft 46 comprises means disposed in surrounding relationship to the torsion member. A small bell crank 48 is rigidly attached to the inner end of the tubular shaft 46. The outer end of the tubular shaft 46 is fixed to the torsion member 28 by suitable means such as by soldering or crimping, as indicated at 50. An opening, not shown, in the lower end of bell crank 48 is aligned with the bore of tubular shaft 46 and permits the torsion member 28 to continue to the anchor point 30, so that the bell crank 48 is free to rotate with respect to the torsion member 28, but not with respect to the tubular shaft 46.

Figure 2:
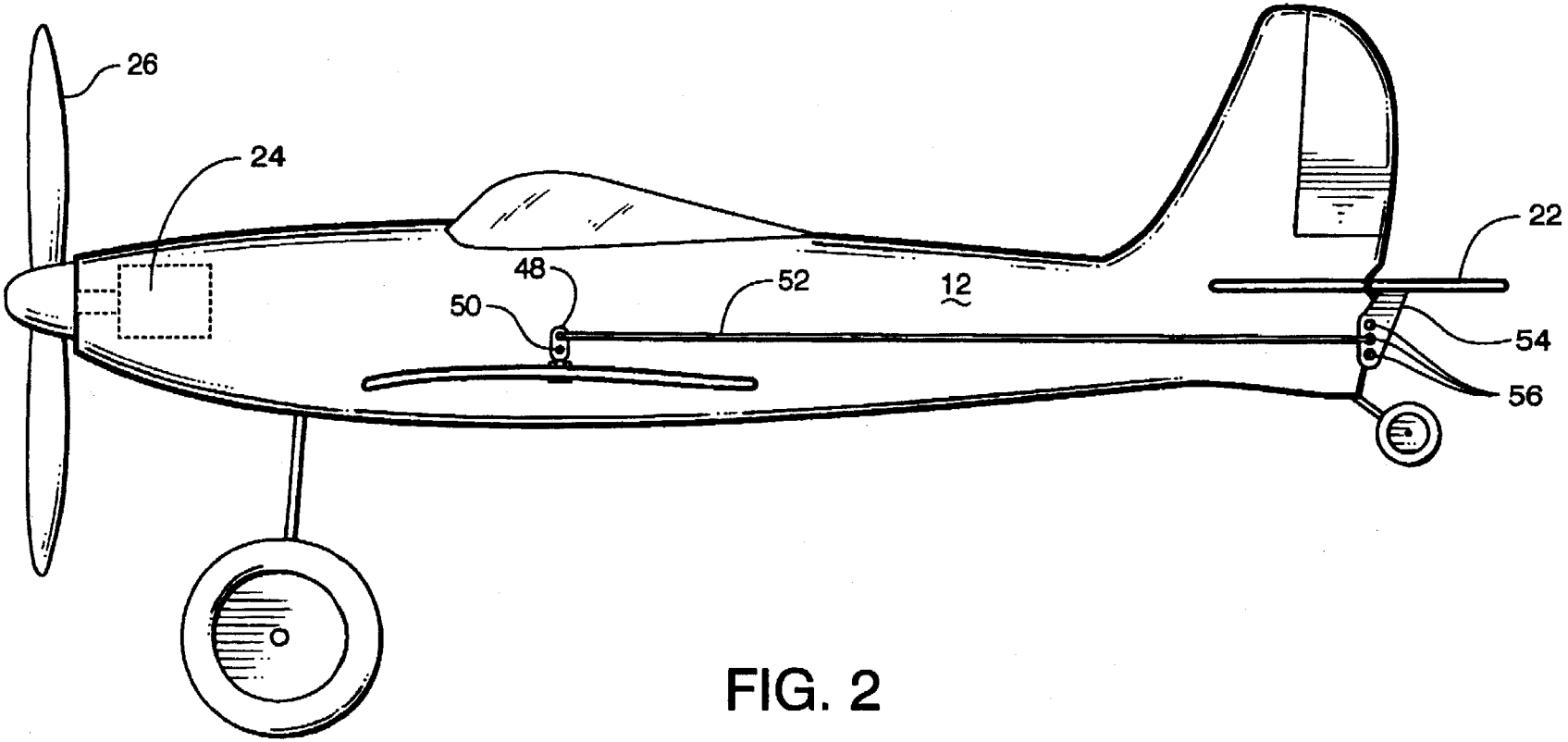
FIG. 2 is a view in side elevation of the model aircraft of FIG. 1, and illustrating details of the elevator control mechanism.

A connecting rod 52, pivotally engaged with the upper portion of the bell crank 48 extends to, and is pivotally engaged with, elevator horn 54 on the underside of the elevator 22. (FIG. 2.) With this arrangement will be appreciated that the bell crank, elevator horn and connecting rod comprise a control device for controlling movement of the elevator up or down. Specifically, rotation of the bell crank 48 in either direction by tubular shaft 46 will be translated as linear movement through connecting rod 52 to elevator horn 54 and cause corresponding rotation of the elevator with respect to the airplane tail 20. Further, it will be appreciated that the bell crank 48 and elevator horn 54 comprise levers, the length of which may be suitably selected to control mechanical advantage as desired in transmitting rotational forces between the tubular shaft 46 and elevator 22. In the preferred embodiment, the shorter leverage provided by the bell crank 48 (leverage being from the point of attachment of tubular shaft 46 to the point of pivotal attachment of the connector 52) in comparison to the longer leverage of the control horn 54 (distance from the underside of the elevator to the point of pivotal attachment of the control rod 52 to the elevator horn 54) serves to firm up the control and to reduce elevator flutter. A plurality of openings 56 in the elevator horn 54 provide means for adjusting the point of pivotal engagement of the push rod 52 and thereby adjusting the relative leverages between the control horn 54 and the bell crank 48.

It will be noted that the effective range of movement for the bell crank 48 is only about 180°, or approximately one-half a turn. FIG. 2 illustrates the bell crank and elevator in a neutral position. Rotation of the bell crank 48 approximately one-quarter turn to the left will move the elevator to its maximum "down" position and rotation of the bell crank approximately one-quarter turn to the right will move the elevator to its maximum "up" position.

Rotational movement of the bell crank 48 is produced by rotation of the tubular shaft 46 due to torsional twisting of torsion member 28 at point 50 where the tubular shaft is fixed to the torsion member 28. Twisting of the torsion member 28 in turn is responsive to torsional force applied to the torsion member by the control line 42 in the manner described below.

Torsional forces on the torsion member 28 are supplied by the torsion control line 42, through loop 40 and button connector 32. Torsion control line 42 extends through a guide 58 on the wing tip, and thence to the control handle 44. The lower end of the torsion control line 42 is releasably attached to control handle 44, which provides means for torquing, or rotating, the lower end of the control line in either a clockwise or counterclockwise direction. Like torsion member 28, control line 42 preferably is formed of music wire, which has the ability to transmit forces by proportional torsional twisting along its length.

Figures 3, 3A:
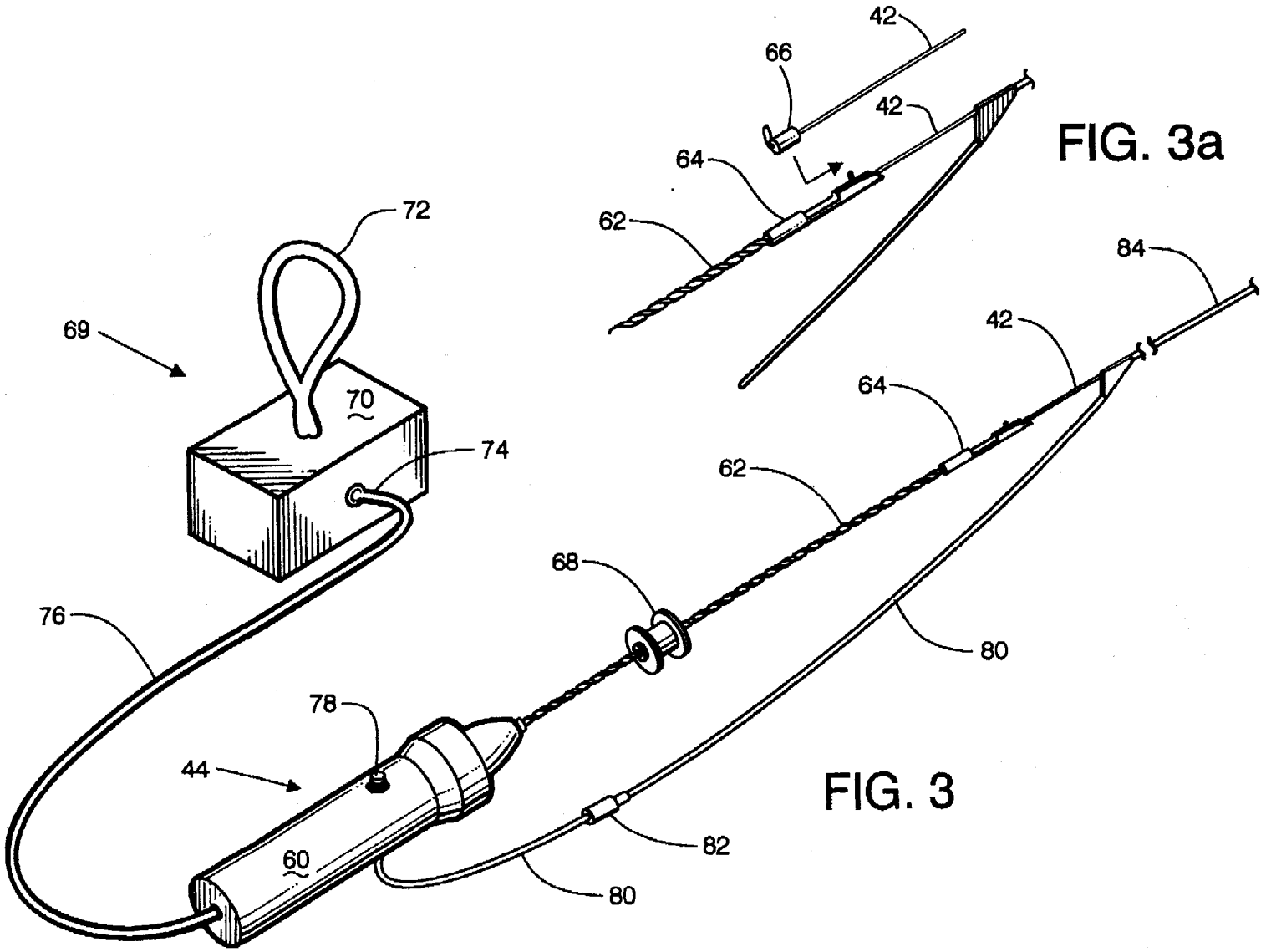
FIG. 3 is an enlarged view of the aircraft control handle of FIG. 1, together with a battery pack for powering the aircraft.
FIG. 3*a* is an enlarged detail illustration of a portion of the control mechanism of FIG. 3, illustrating how the torsional control line is removably engaged with the control handle.

The control handle 44 preferably includes a plastic grip 60 which may be held in one hand of the aircraft operator and an elongated twisted steel spiral shaft 62 which is rotatably journaled in the grip 60. The spiral shaft 62 terminates in a slotted fitting 64 (FIG. 3*a*) into which a slide 66 attached to the lower end of the control line 42 may be removably received (as illustrated in FIG. 3*a*) and held in nonrotating relationship with respect to the spiral shaft 62 so that it will rotate with the shaft 62. A control knob 68 is provided on the spiral shaft 62 in threaded relationship so that the shaft 62 may be made to rotate, either clockwise or counterclockwise, with respect to the stationary grip 60 by moving the control knob back and forth along the spiral shaft 62. In this manner, the lower end of the control line 42 may be torqued, or rotated, in either a clockwise or counterclockwise direction as desired by the aircraft operator to thereby control operation of the control device and control surface on the aircraft. It will be appreciated by those skilled in the art that the amount of torque transmitted from the control handle 44 to the control device via torsional control line 42 will be proportional to the length, thickness and rigidity of the control line 42, as well as to the number of rotations of the lower end of the control wire 42 induced by movement of the slide 68 along the spiral shaft 62.

Although the preferred use of the control device on the aircraft is for positioning of the elevator 22, the control device also may be used to control positioning of another movable flight control surface such as wing flaps, or to control any other desired aircraft functions, such as engine speed.

Rotation of the tubular shaft 46 to control operation of the bell crank 48 is accomplished by torquing, or rotating, the lower end of the control line 42 by means of the control handle 44. Assuming that the torsion member 28 and control line 42 are formed of the same diameter music wire, the amount of rotative action transmitted from the control handle to the bell crank will be roughly proportional to the lengths A and B (FIG. 4), where A is the length of torsion member 28 between the point of attachment 30 to the aircraft body and the point 50 of attachment of the torsion member to the tubular shaft 46, and B is the total length of torsional control line 42, plus the length of torsion member 28 between the button connector 32 and the point of attachment 50 of the tubular shaft 46 to torsion member 28. For example, if distance A is 6 inches and distance B is 30 feet, and if the torsion member 28 and control line 42 are formed of the same material, the ratio will be approximately 1:60. Thus an approximately one-quarter turn of the bell crank 48 to the right would require approximately 15 rotations of the control handle spiral shaft 62 to the right. However, these ratios are only approximate. The ratios also can be adjusted by adjusting the point of attachment of the tubular shaft 46 to the torsion member 28 as well as by adjusting the relative diameters of the torsion member 28 and control line 42, so as to affect their relative torsional stiffness. Suitable adjustments to achieve the desired result are well within the skill of those knowledgeable in the art.

For example, by reducing the diameter of the torsion member 28 relative to that of the control line 42, its torquing resistance is decreased and its proportional revolutions are increased concomitantly. By the same token, by lengthening the tubular shaft 42, so as to move the point 50 of connection of the tubular shaft 42 to the torsion member 28 farther revolutions of the torsion member 28 transmitted to the tubular shaft 46 will be increased.

Preferably, the torsion control line 42 is detachable from both the torsion member 28 and the control handle 44 for ease of handling and transportation. However, it will be apparent to those skilled in the art that the torsion member and control line could be made continuous without changing the method of operation of the apparatus.

It will be apparent that some torsional loading imposed on torsion member 28 which is not absorbed by twisting of the torsion member 28 will be transmitted to the aircraft body at the point where the torsion member is affixed to the aircraft. This torsional force will have some tendency to rotate the aircraft with respect to its lateral axis, however, this rotational force is small compared to the rotational force exerted by raising or lowering the elevator 22, so that control of attitude of the aircraft will remain under the influence of the elevator 22.

The torsional control mechanism as described may be used with any type of self-propelled model aircraft, regardless of how the aircraft is powered. However, in the preferred embodiment, the aircraft with which the improved control mechanism is used is powered by an on-board DC electric motor which receives electricity from a ground based electric storage battery carried by the aircraft operator.

In the preferred embodiment, the on-board engine 24 is a 12 volt DC electric motor powered by a ground based battery via electrical connection means extending between the battery and the motor 24. Referring to FIG. 3, there is illustrated battery means 69 comprising a battery case 70 containing a suitable electrical storage battery, such as a 12 volt sealed gelled acid battery. Case 70 is provided with a handle or strap 72, which preferably is a shoulder strap, permitting the battery to be carried from the shoulder of the airplane operator. Means such as an electrical jack 74 are provided for releasable electrical connection of a power lead 76 extending between the battery and aircraft control handle 44. Jack 74 also provides means for recharging the battery.

A push button switch 78 in the plastic grip is suitably electrically connected between the battery lead 76 and another lead 80 extending toward the control line 42. Disconnect means 82 are provided in the lead 80 for selectively disconnecting the electric lead 80 when torsion control line 42 is disconnected from the handle 44.

Electrical leads 78 and 80 each contain at least two insulated electrical conductors for conducting electrical power between the battery and the aircraft engine. Lead 80 is brought into alignment with the torsion control line 42 by bracket 82. From there, and extending to the aircraft, the torsion control line 42 and a plurality of insulated electrical leads are confined within a single elongated flexible sheath 84, to comprise a combined electrical connector torsion control line 85 for the model aircraft 10.

Figure 5:
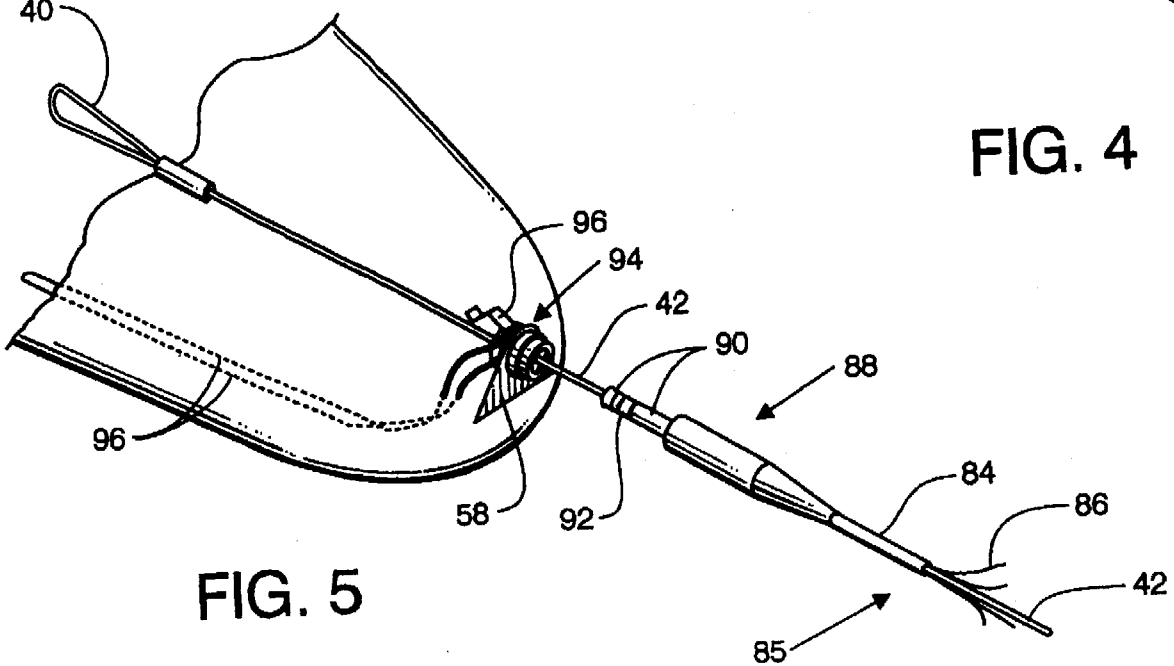
FIG. 5 is an enlarged detail view of a portion of the wing tip and composite control line of the model aircraft of FIG. 1, illustrating details of the means for electrical and mechanical connection of the control line to the aircraft.

Referring now to FIG. 5, there is shown in greater detail the construction of the combination torsion control and electrical power line and its means of electrical connection to the aircraft. Within the elongated flexible sheath 84 are contained the torsion control line 42 and two or more flexible insulated electric conductors 86. The insulated electrical conductors 86 comprise an electrically conductive material, such as copper or aluminum wire, covered with an insulating material such as a polymer. Magnet wire, especially copper clad aluminum core magnet wire, is preferred because of its light weight, small diameter and the compactness of the plastic insulation material applied by the manufacturers. These factors reduce the overall diameter of the composite control line, which is highly desirable because of the concomitant reduction of air drag which the control line exerts on the airplane. Copper clad aluminum magnet wire, consisting of approximately 90% aluminum and 10% copper has electrical and soldering capabilities comparable to those of all copper wire, while having substantially reduced weight.

Means are provided for releasable mechanical and electrical connection of the composite control line to the aircraft. As shown in FIG. 5, an electric plug 88 is provided near one end of the composite control line and has two electrical conductor surfaces 90 separated by insulator 92. The electric plug 88 cooperates with an electric jack 94 carried by bracket 58 on the air plane wing tip. When the plug 88 is inserted into jack 94, an electrical conductor 96 on the jack 94 contacts one of the conductor surfaces 90 on the plug and another electrical conductor, not shown, inside the jack contacts the other conductor surface 90. Insulated electrical leads 96 conduct electrical power from the jack 94 to the electric motor 24.

The torsion control line 42 extends through a bore (not shown) in electrical plug 88 and through the jack 94, so that wire loop 40 on the end of torsion wire 42 can be connected to button connector 32, as described above, to mechanically and torsionally connect the composite control line 82 to the aircraft.

Figure 6:
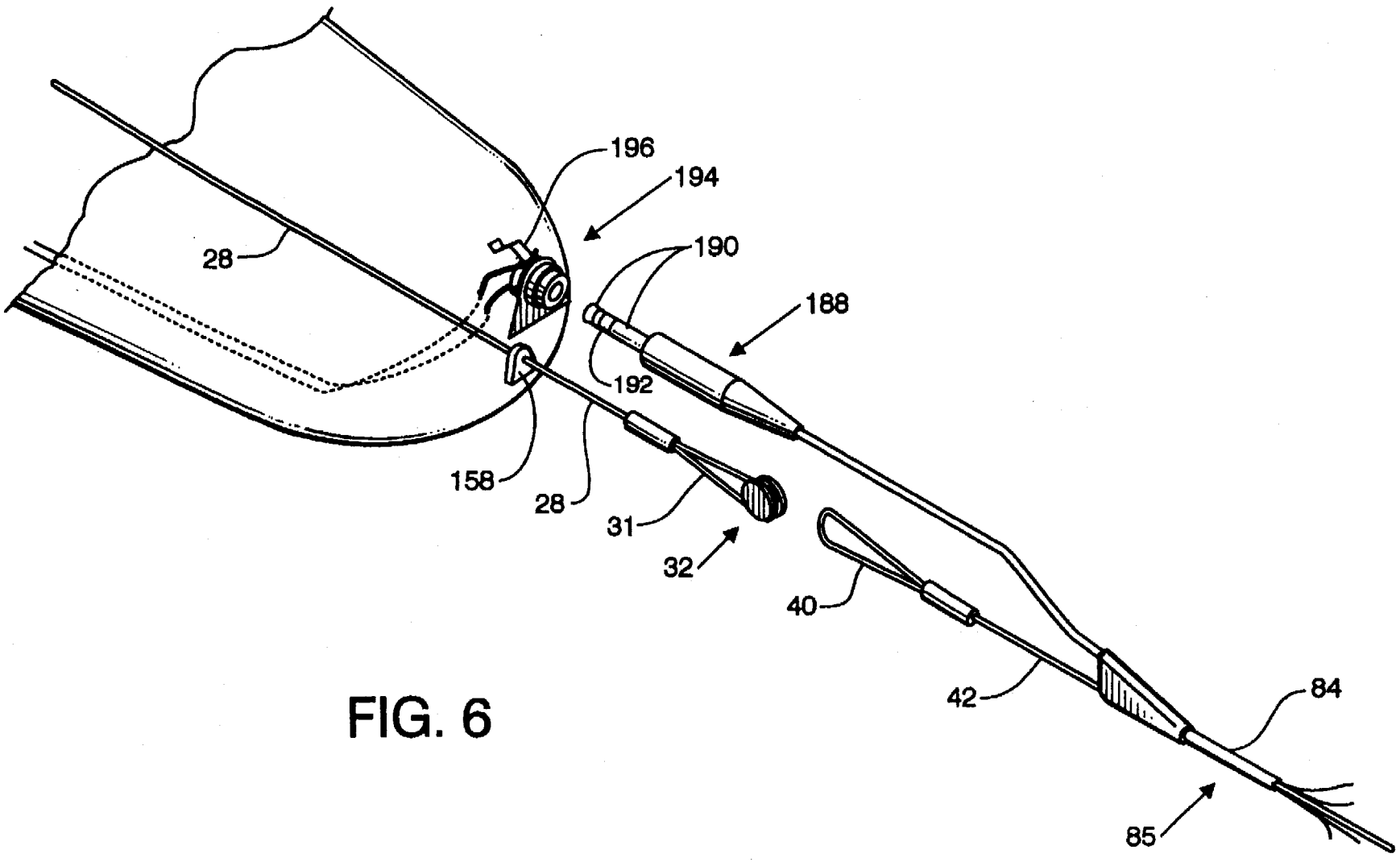
FIG. 6 is an enlarged detail view similar to FIG. 5, illustrating an alternate embodiment of the means for mechanical and electrical connection of the control line to the aircraft.

Referring to FIG. 6, there is shown an alternate embodiment of the means for mechanical and electrical connection of the composite control line 85 to the aircraft. In this alternate embodiment, the torsion line 42 does not extend through the electric plug or above the wing tip. Instead, torsion member 28 extends through guide 158 on the wing tip and has its terminating loop 31 and the button connector 32 out-board of the wing tip. Electric plug 188 is separated from the control line 85 out-board of the aircraft wing, and engages a jack 194 on the aircraft wing which is spaced from the bracket 158. This arrangement has the advantage of providing for the connecting assembly and disassembly of the control line to be made entirely outside of the wing instead of atop the wing, and is somewhat easier to use for less experienced or less dextrous operators. The alternate design of FIG. 6 also has the advantage that the bore of the jack 194 need not be sufficiently large in diameter to accommodate loop 40 on the end of torsion control line 42.

It will be appreciated that, with the apparatus disclosed, the airplane, composite control line, control handle and battery all are provided as separate units, but adapted for rapid assembly when it is desired to fly the airplane.

The foregoing disclosure and description of the invention are illustrative only and various changes may be made within the scope of the appended claims, without departing from the spirit of the invention.

What is claimed is:

1. In a self-propelled model aircraft of the type including a fuselage, a wing and at least one movable control surface wherein attitude control of the aircraft is accomplished by means of movement of said control surface on the raft, the improvement which comprises:

a control device on said aircraft adapted for controlling movement of said control surface;

a torsion member adapted to twist proportionally along its longitudinal axis in response to an imposed torsional loading, said torsion member having one end nonrotatably attached to one of said fuselage and said wing of said aircraft and the other end adapted to be nonrotatably attached to means for transmitting torsional loading to said torsion member; and tubular shaft means disposed in surrounding relationship to a portion of said torsion member and in proximity to said aircraft, said tubular shaft means being nonrotatably attached at its end nearest said aircraft to said control device and being nonrotatably attached at its other end to said torsion member, whereby torsion forces transmitted to said torsion member will cause proportional twisting along the longitudinal axis of said torsion member and rotation of said tubular shaft and said control device, for controlling movement of said control surface.

2. The aircraft according to claim 1 wherein the amount of angular rotation of said tubular shaft is proportional to the distance between the point of attachment of said torsion member to said aircraft and the point of attachment of said tubular shaft to said torsion member.

3. The aircraft according to claim 1 wherein said control device comprises first means for providing leverage nonrotatably attached to said end of said tubular shaft nearest to said aircraft, second means for providing leverage attached to said control surface and connector means rigidly interconnecting said first and second means for providing leverage, whereby rotation of said first means for providing leverage by said tubular shaft is translated by said connector means to said second means for providing leverage, to thereby cause movement of said control surface.

4. The apparatus according to claim 1 comprising additionally means for transmitting torsional forces to said torsion member.

5. The apparatus according to claim 4 wherein said means for transmitting torsional forces comprise a torsion control line releasably nonrotationally engagable at one end with said torsion member and adapted to transmit torsional forces between a control handle adapted to be carried by an aircraft operator and said torsion member.

6. The apparatus to claim 5 comprising additionally a control handle adapted to be held by the aircraft operator and including means for releasable nonrotational engagement with said torsion control line and for rotating said torsion control line when engaged with said control handle.

7. The apparatus according to claim 1 wherein said control surface on said aircraft comprises an elevator.

8. An apparatus comprising:

a self-propelled model aircraft including a fuselage, at least one wing and a movable control surface for controlling the attitude of said aircraft in flight;

a control device on said aircraft adapted for controlling movement of said control surface;

an elongated torsion member adapted to twist proportionally along its length in response to an imposed torsional loading, said torsion member having one end nonrotatably attached to one of said fuselage and said wing of said aircraft and the other end adapted to be releasably nonrotatably attached to a torsion control line for transmitting torsional loading forces to said torsion member;

tubular shaft means disposed in surrounding relationship to a portion of said torsion member and in proximity to said aircraft, said tubular shaft means being nonrotatably attached at one end to said control device and nonrotationally attached at the other end to said elongated torsion member, whereby torsional forces transmitted through said torsion control line to said torsion member will induce rotation of said tubular shaft means and said control device, for controlling said movement of said control surface.

9. The apparatus according to claim 8, comprising additionally a torsion control line adapted to be releasably nonrotatably attached at one end to said torsion member and adapted to be nonrotatably attached at the other end to means for torquing said torsion control line.

10. The apparatus according to claim 9 wherein said means for torquing said torsion control line comprises:

a control handle releasably nonrotatably engagable with said other end of said torsion control line and capable of rotating said other end of said torsion control line in either a clockwise or counterclockwise direction.

11. The apparatus according to claim 10 comprising additionally a DC electric motor on said aircraft adapted to rotate an air impeller for powering said aircraft in flight;

battery means electrically connectable to said control handle and adapted to supply electrical power to said on-board electric motor; and electrical conductor means adapted to extend between and interconnect said control handle and said electric motor for transmitting electric power from said battery to said motor.

12. The apparatus according to claim 11 wherein said elongated electrical conductor means and said torsion control line are contained within a single elongated flexible sheath extending in surrounding relationship to said elongated electrical conductor means and said torsion control line for substantially the entire distance from said airplane to said control handle.

13. The apparatus according to claim 12 comprising additionally means for releasable electrical connection of said elongated conductor means to said aircraft and for releasable electrical connection of said elongated conductor means to said control handle.

14. A combination electrical conductor and torsion control line adapted for use with a model airplane of the type having an on-board electric motor and an on-board mechanism for control of a control surface on said airplane by means of tension and torsion control forces exerted on said on-board mechanism, said combination electrical conductor and torsion control line comprising:

an elongated flexible sheath;

an elongated torsion control line inside said flexible sheath and having means on one end for releasable mechanical connection to said on-board mechanism on said aircraft and means on the other end for releasable connection to a control handle for imparting tension and torsion control forces to said other end of said torsion control line, said torsion control line being adapted to carry all tension and torsion control force exerted on said airplane and being adapted to twist proportionally along its longitudinal axis in response to an imposed torsional loading;

a plurality of insulated elongated flexible electrical conductors disposed inside said sheath and having means at one end for releasable electrical connection to said electric motor and means at the other end for releasable electrical connection with an electrical storage battery, said elongated electrical conductors not being adapted to exert either tension or torsion control forces on said airplane.

15. The apparatus according to claim 14 wherein said plurality of insulated elongated flexible conductors comprise magnet wire.

16. The apparatus according to claim 14 wherein said plurality of insulated elongated flexible conductors comprise aluminum core, copper-clad wire.

17. In a self-propelled model aircraft of the type including a fuselage, at least one wing and a movable control surface for controlling the attitude of said aircraft in flight, the improvement which comprises:

a control device on said aircraft adapted for controlling movement of said control surface;

a torsion member adapted to twist proportionally along its longitudinal axis in response to an imposed torsional loading, said torsion member having one end nonrotatably attached to one of said fuselage and said wing of said aircraft and the other end nonrotatably attached to means for transmitting torsional loading to said torsion member; and tubular shaft means disposed in surrounding relationship to a portion of said torsion member and in proximity to said aircraft, said tubular shaft means being nonrotatably attached at its end nearest said aircraft to said control device and being nonrotatably attached at its other end to said torsion member, whereby torsion forces transmitted to said torsion member will cause proportional twisting along the longitudinal axis of said torsion member and rotation of said tubular shaft and said control device, for controlling movement of said control surface.

18. A model aircraft comprising:

an airplane body including a fuselage, at least one wing and a movable control surface for controlling the attitude of said aircraft;

an electric motor on said aircraft for powering said aircraft;

a torsion control mechanism on said aircraft for torsion control of said control surface, said torsion control mechanism comprising, a control device on said aircraft adapted for a controlling movement of said control surface, a torsion member adapted to twist proportionally along its longitudinal axis in response to an imposed torsional loading, said torsion member having one end nonrotatably attached to one of said fuselage and said wing of said aircraft and having means on the other end for releasable mechanical connection to an elongated torsion control line, and tubular shaft means disposed in surrounding relationship to a portion of said torsion member and in proximity to said aircraft, said tubular shaft means being nonrotatably attached at its end nearest said aircraft to said control device and being nonrotatably attached at its other end to said torsion member; and a combination electrical conductor and torsion control line comprising, an elongated flexible sheath, an elongated torsion control line inside said flexible sheath and having means on one end for releasable mechanical connection to said torsion member on said aircraft and means on the other end for releasable mechanical connection to a control handle for imparting torsion forces to said other end of said torsion control line, and a plurality of insulated elongated flexible electrical conductors disposed inside such sheath and having means at one end for releasable electrical connection to said electric motor and means at the other end for releasable electrical connection to an electrical storage battery, whereby torsion forces transmitted from said control handle, through said elongated torsion control line to said torsion member will cause proportional twisting along the longitudinal axis of said torsion member and rotation of said tubular shaft and said control device, for controlling movement of said control surface and electrical power transmitted from said electrical storage battery through said elongated flexible conductors to said electric motor will provide electric power for powering said aircraft.

* * * * *